US008789372B2

(12) United States Patent
Johnson et al.

(10) Patent No.: US 8,789,372 B2
(45) Date of Patent: Jul. 29, 2014

(54) INJECTOR WITH INTEGRATED RESONATOR

(75) Inventors: Thomas Edward Johnson, Greer, SC (US); Willy Steve Ziminsky, Simpsonville, SC (US); William David York, Greer, SC (US); Christian Xavier Stevenson, Inman, SC (US)

(73) Assignee: General Electric Company, Schenectady, NY (US)

( * ) Notice: Subject to any disclaimer, the term of this patent is extended or adjusted under 35 U.S.C. 154(b) by 891 days.

(21) Appl. No.: 12/499,777

(22) Filed: Jul. 8, 2009

(65) Prior Publication Data

US 2011/0179795 A1 Jul. 28, 2011

(51) Int. Cl.
*F02C 7/24* (2006.01)
*F23R 3/28* (2006.01)

(52) U.S. Cl.
USPC ..... 60/725; 60/737; 60/747

(58) Field of Classification Search
USPC ..... 60/725, 737, 746, 747, 748
See application file for complete search history.

(56) References Cited

U.S. PATENT DOCUMENTS

| | | | | |
|---|---|---|---|---|
| 5,096,010 | A | 3/1992 | Ojala et al. | |
| 5,259,184 | A * | 11/1993 | Borkowicz et al. | 60/737 |
| 5,349,141 | A | 9/1994 | Horibe et al. | |
| 5,373,695 | A | 12/1994 | Aigner et al. | |
| 5,431,018 | A | 7/1995 | Keller | |
| 5,450,725 | A * | 9/1995 | Takahara et al. | 60/737 |
| 5,467,926 | A * | 11/1995 | Idleman et al. | 60/737 |
| 5,644,918 | A | 7/1997 | Gulati et al. | |
| 5,771,851 | A | 6/1998 | McLean | |
| 5,894,823 | A | 4/1999 | Lee | |
| 6,178,752 | B1 * | 1/2001 | Morford | 60/737 |
| 6,460,326 | B2 * | 10/2002 | Bechtel et al. | 60/740 |
| 6,530,221 | B1 | 3/2003 | Sattinger et al. | |
| 6,758,304 | B1 | 7/2004 | McLean | |
| 6,820,431 | B2 | 11/2004 | McManus et al. | |
| 6,923,002 | B2 | 8/2005 | Crawley et al. | |
| 6,938,601 | B2 | 9/2005 | Fukumoto | |
| 6,973,790 | B2 * | 12/2005 | Suenaga et al. | 60/725 |
| 7,117,974 | B2 | 10/2006 | Moenssen et al. | |
| 7,246,493 | B2 * | 7/2007 | Flohr et al. | 60/725 |
| 7,331,182 | B2 * | 2/2008 | Graf et al. | 60/725 |
| 7,461,719 | B2 | 12/2008 | Tobik et al. | |

(Continued)

FOREIGN PATENT DOCUMENTS

| | | |
|---|---|---|
| DE | 4414232 | 10/1995 |
| DE | 10004991 | 8/2001 |

(Continued)

OTHER PUBLICATIONS

U.S. Appl. No. 12/960,422, filed Dec. 3, 2010, Swanand Vijay Sardeshmukh.

(Continued)

*Primary Examiner* — Ted Kim
(74) *Attorney, Agent, or Firm* — Fletcher Yoder, P.C.

(57) ABSTRACT

The system may include a turbine engine. The turbine engine may include a fuel nozzle. The fuel nozzle may include an air path. The fuel nozzle may also include a fuel path such that the fuel nozzle is in communication with a combustion zone of the turbine engine. Furthermore, the fuel nozzle may include a resonator. The resonator may be disposed in the fuel nozzle directly adjacent to the combustion zone.

20 Claims, 7 Drawing Sheets

(56) References Cited

U.S. PATENT DOCUMENTS

| | | | | |
|---|---|---|---|---|
| 7,464,552 | B2 | 12/2008 | Sattinger | |
| 7,549,506 | B2 | 6/2009 | Sattinger | |
| 7,661,267 | B2 | 2/2010 | Pollarolo | |
| 7,788,926 | B2 | 9/2010 | Johnson et al. | |
| 2002/0000343 | A1 | 1/2002 | Paschereit et al. | |
| 2005/0098379 | A1 | 5/2005 | Sato et al. | |
| 2006/0059913 | A1 | 3/2006 | Bethke et al. | |
| 2008/0041058 | A1 | 2/2008 | Johnson et al. | |
| 2008/0173271 | A1 | 7/2008 | Prior et al. | |
| 2008/0245337 | A1 | 10/2008 | Bandaru et al. | |
| 2008/0295519 | A1 * | 12/2008 | Park | 60/740 |
| 2010/0011769 | A1 | 1/2010 | Gambacorta et al. | |

FOREIGN PATENT DOCUMENTS

| | | | |
|---|---|---|---|
| EP | 0974788 | | 1/2000 |
| EP | 1085201 | | 3/2001 |
| EP | 1557609 | | 7/2005 |
| EP | 1669670 | A1 | 6/2006 |
| JP | H06221563 | A | 8/1994 |
| JP | 07139738 | A | 5/1995 |
| JP | 8158964 | A | 6/1996 |
| JP | 9126074 | A | 5/1997 |
| JP | H11311415 | A | 11/1999 |
| JP | 2004509313 | A | 3/2004 |
| JP | 2004150793 | A | 5/2004 |
| JP | 2006030396 | A | 2/2006 |
| JP | 2008256351 | A | 10/2008 |

OTHER PUBLICATIONS

U.S. Appl. No. 13/212,105, filed Aug. 17, 2011, Mohan Krishna Bobba.

U.S. Appl. No. 13/189,085, filed Jul. 22, 2011, Kwanwoo Kim.

Unofficial English translation of JP Office Action dated Jan. 28, 2014, issued in connection with corresponding JP Application No. 2010-106063.

* cited by examiner

INJECTOR WITH INTEGRATED RESONATOR

STATEMENT REGARDING FEDERALLY SPONSORED RESEARCH & DEVELOPMENT

This invention was made with Government support under contract number DE-FC26-05NT42643 awarded by the Department of Energy. The Government has certain rights in the invention.

BACKGROUND OF THE INVENTION

The subject matter disclosed herein relates to a device that may dampen acoustic oscillations in a fuel nozzle.

A gas turbine engine combusts a mixture of fuel and air to generate hot combustion gases, which in turn drive one or more turbines. In particular, the hot combustion gases force turbine blades to rotate, thereby driving a shaft to rotate one or more loads, e.g., electrical generator. Certain parameters may induce or increase pressure oscillations in the combustion process, thereby reducing performance and efficiency of the gas turbine engine or causing damage to engine components. For example, the pressure oscillations may be at least partially attributed to fluctuations in fuel pressure or air pressure directed into a combustor. These fluctuations may drive combustor pressure oscillations at various frequencies. If one of the frequency bands corresponds to a natural frequency of a part or subsystem within the gas turbine engine, then the resulting combustor pressure oscillations may be particularly detrimental to the performance and life of the gas turbine engine. The occurrence of high-frequency pressure oscillations is generally referred to as screech in the combustor, and this condition can be particularly detrimental to the life of combustion system components

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a turbine engine, comprising a fuel nozzle having an air path and a fuel path, wherein the fuel nozzle is in communication with a combustion zone of the turbine engine, and a resonator disposed in the fuel nozzle directly adjacent to the combustion zone.

In a second embodiment, a system includes a fuel nozzle, comprising a fuel path configured to supply fuel, an air path configured to supply air, and a resonator disposed along the air path, wherein the resonator comprises a resonator chamber having an air inlet and an air outlet, and the air outlet extends through an outer wall of the fuel nozzle facing the combustion chamber In a third embodiment, a fuel nozzle includes a fuel path, wherein the fuel nozzle is located in the fuel path, mixing tubes concentrically displaced about the fuel path and configured to mix air from a first air path with fuel from the fuel path, an air compartment in a downstream portion of the fuel nozzle, wherein the air compartment is circumferentially surrounded by the mixing tubes, a second air path configured to supply air to the air compartment, and a resonator disposed in the air compartment.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Embodiments of the disclosed invention incorporate a resonator device directly in a fuel nozzle. The fuel nozzle may, for example, be located in a turbine engine. The fuel nozzle may utilize a plurality of mixing tubes to achieve optimal mixing, which may lead to a propensity to stimulate high frequency combustion dynamics known as screech. The resonator may operate to dampen the combustion generated acoustic oscillations. In certain embodiments, the resonator may be located in close proximity to the oscillations to maximize the dampening effect. For example, the resonator may be placed directly in the body of the fuel nozzle, e.g. in the middle and/or tip of the fuel nozzle.

Additionally, the resonator may be tuned to dampen oscillations of a certain frequency. This tuning may be accomplished by varying dimensions of air intake ports and air outlet ports of the resonator, varying the number of air intake ports and air outlet ports in the resonator, and/or varying the volume of the cavity in the resonator. The volume of the cavity may be adjusted by changing the length of an upstream plate of the resonator and/or the side plates of the resonator. Additionally, more than one cavity may be utilized in conjunction with the resonator, so that more than one frequency may be dampened.

Figure 1:
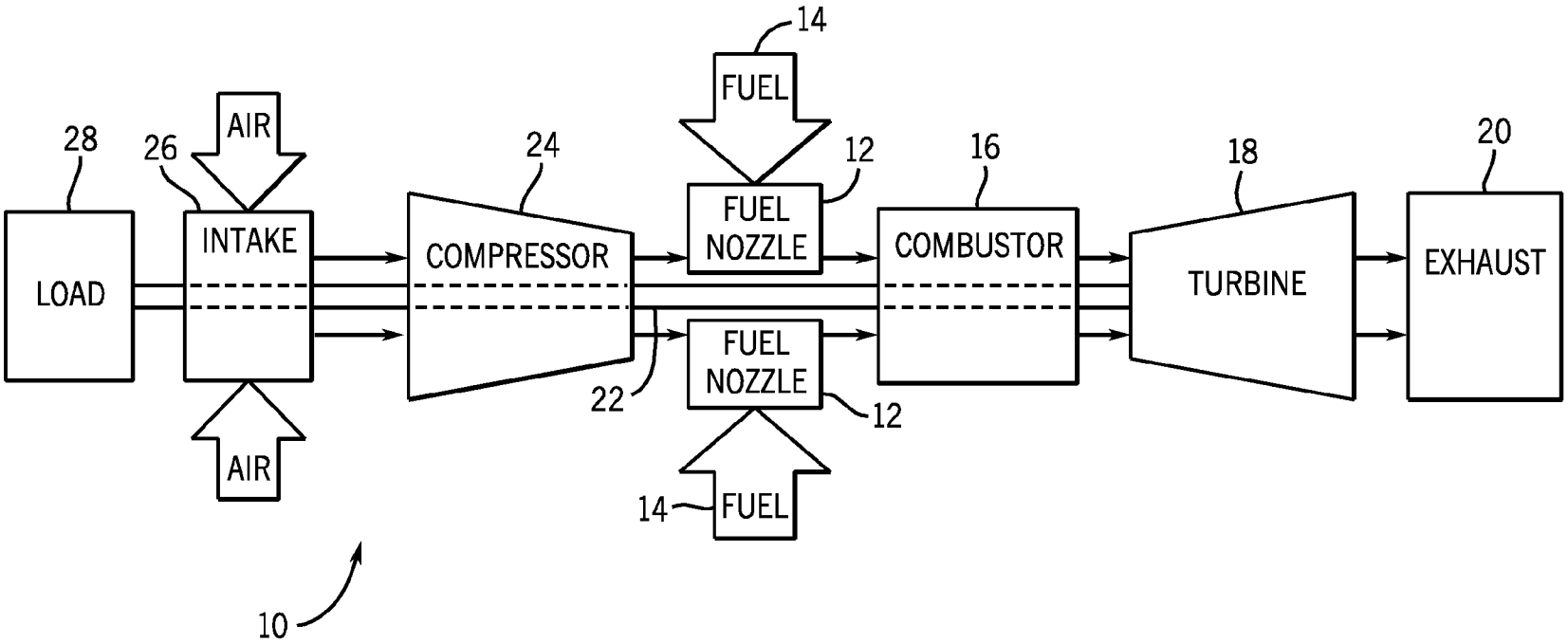
FIG. 1 is a block diagram of a turbine system having a fuel nozzle coupled to a combustor in accordance with an embodiment of the present technique.

Turning now to the drawings and referring first to FIG. 1, an embodiment of a turbine system 10 may include one or more fuel nozzles 12. Although acoustic oscillations may be generated during combustion of fuel from the fuel nozzles, the disclosed embodiments of the fuel nozzles 12 include integral resonators to dampen these oscillations. The turbine system, (e.g., gas turbine engine), 10 may use liquid or gas fuel, such as natural gas and/or a hydrogen rich synthesis gas, to run the turbine system 10. As depicted, a plurality of fuel nozzles 12 intakes a fuel stream 14, mixes the fuel with air, and distributes the air-fuel mixture into a combustor 16. The air-fuel mixture combusts in a chamber within combustor 16, thereby creating hot, pressurized exhaust gases. The combustor 16 directs the exhaust gases through a turbine 18 toward an exhaust outlet 20. As the exhaust gases pass through the turbine 18, the gases force one or more turbine blades to rotate a shaft 22 along an axis of the system 10. As illustrated, the shaft 22 may be connected to various components of the turbine system 10, including a compressor 24. The compressor 24 also includes blades that may be coupled to the shaft 22. As the shaft 22 rotates, the blades within the compressor 24 also rotate, thereby compressing air from an air intake 26 through the compressor 24 and into the fuel nozzles 12 and/or combustor 16. The shaft 22 may also be connected to a load 28, which may be a vehicle or a stationary load, such as an electrical generator in a power plant or a propeller on an aircraft, for example. As will be understood, the load 28 may include any suitable device capable of being powered by the rotational output of turbine system 10.

Figure 2:
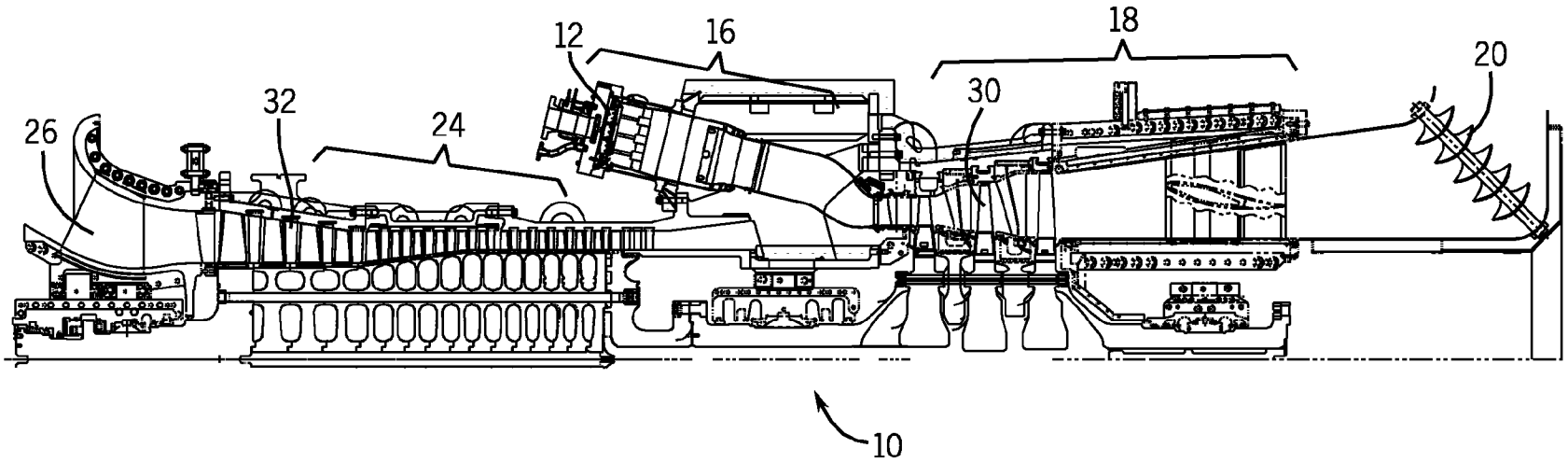
FIG. 2 is a cutaway side view of an embodiment of the turbine system, as illustrated in FIG. 1, in accordance with an embodiment of the present technique.

FIG. 2 illustrates a cutaway side view side view of an embodiment of the turbine system 10 schematically depicted in FIG. 1. The turbine system 10 includes one or more fuel nozzles 12 located inside one or more combustors 16. Again, as discussed in further detail below, each illustrated fuel nozzle 12 may include multiple fuel nozzles integrated together in a group and/or a standalone fuel nozzle, wherein each illustrated fuel nozzle 12 may include an acoustic dampener, such as a resonator, to reduce dynamic oscillations in the combustor 16. In operation, air enters the turbine system 10 through the air intake 26 and may be pressurized in the compressor 24. The compressed air may then be mixed with gas for combustion within combustor 16. For example, the fuel nozzles 12 may inject a fuel-air mixture into the combustor 16 in a suitable ratio for optimal combustion, emissions, fuel consumption, and power output. The combustion generates hot pressurized exhaust gases, which then drive one or more blades 30 within the turbine 18 to rotate the shaft 22 and, thus, the compressor 24 and the load 28. The rotation of the turbine blades 30 causes rotation of the shaft 22, thereby causing blades 32 within the compressor 22 to draw in and pressurize the air received by the intake 26.

Figure 3:
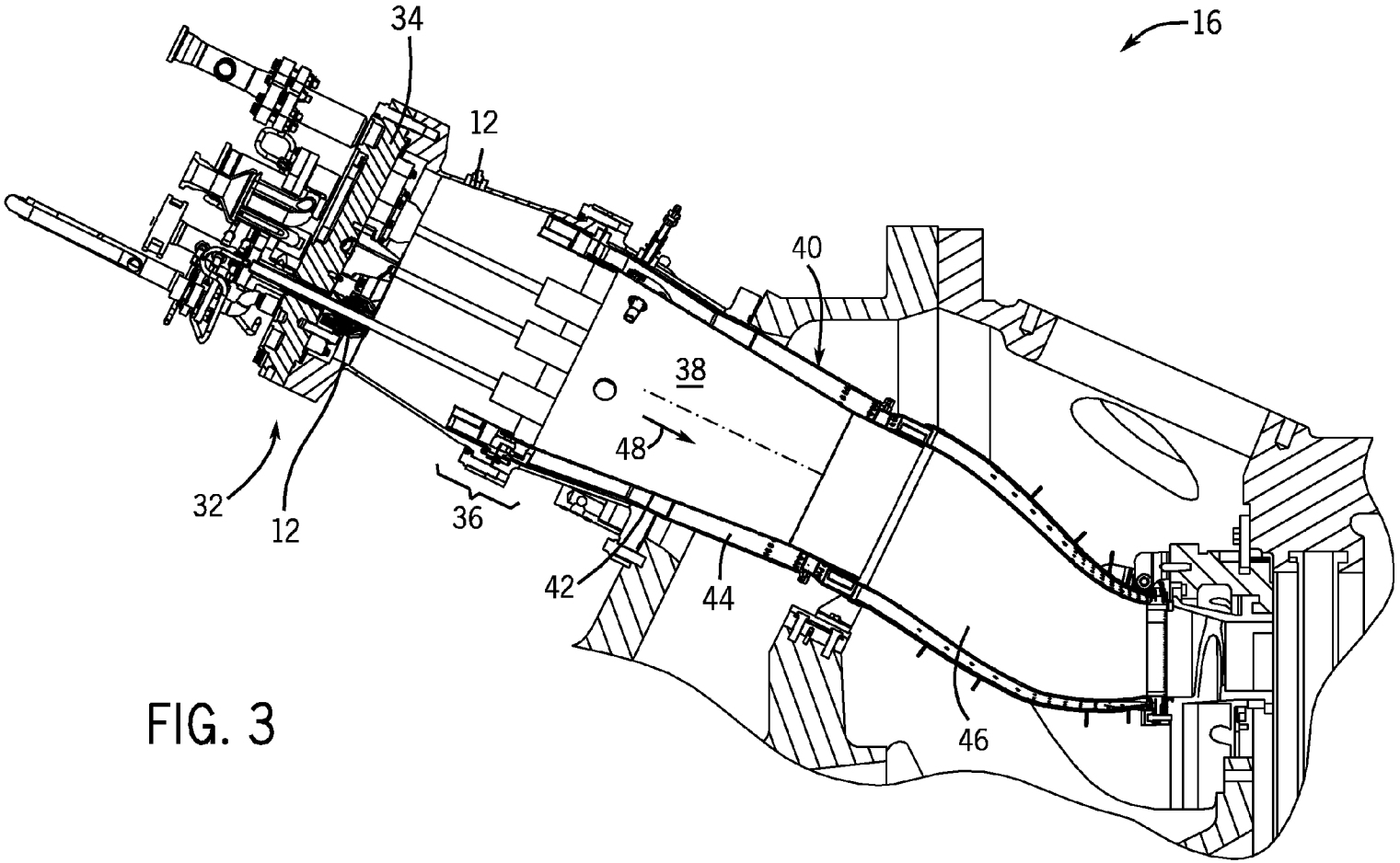
FIG. 3 is a cross sectional side view of an embodiment of the combustor having one or more fuel nozzles, as illustrated in FIG. 2, in accordance with an embodiment of the present technique.

FIG. 3 is a cross sectional side view of an embodiment of combustor 16 having a plurality of fuel nozzles 12. In certain embodiments, a head end 32 of a combustor 16 includes an end cover 34. Additionally, head end 32 of the combustor 16 may include a combustor cap assembly 36, which closes off a combustion chamber 38 and houses the fuel nozzles 12. The fuel nozzles 12 route fuel, air, and other fluids to the combustor 16. In the diagram, a plurality of fuel nozzles 12 are attached to end cover 34, near the base of combustor 16, and pass through the combustor cap assembly 36. For example, the combustor cap assembly 36 receives one or more fuel nozzles 12 and may provide support for each fuel nozzle 12. Each fuel nozzle 12 facilitates mixture of pressurized air and fuel and directs the mixture through the combustor cap assembly 36 into the combustion chamber 38 of the combustor 16. The air fuel mixture may then combust in the combustor 16, thereby creating hot pressurized exhaust gases. These pressurized exhaust gases drive the rotation of blades within turbine 20. Combustor 16 includes a flow sleeve 40 and a combustor liner 42 forming the combustion chamber 38. In certain embodiments, flow sleeve 40 and liner 42 are coaxial or concentric with one another to define a hollow annular space 44, which may enable passage of air for cooling and entry into the combustion zone 38 (e.g., via perforations in liner 42 and/or fuel nozzles 12 and/or cap assembly 36). The design of the flow sleeve 40 and liner 42 provide optimal flow of the air fuel mixture to transition piece 46 (e.g., converging section) along directional line 48 towards turbine 20. For example, fuel nozzles 12 may distribute a pressurized air fuel mixture into combustion chamber 38, wherein combustion of the mixture occurs. The resultant exhaust gas flows through transition piece 46 along directional line 48 to turbine 18, causing blades of turbine 18 to rotate, along with the shaft 22.

During this process, combustion may occur downstream of the combustor cap assembly 36. This combustion may cause pressure fluctuations, or combustion dynamics, to be generated. These combustion dynamics may be acoustic oscillations that may be triggered by the mixing of air and fuel in, for example, a plurality of premixing tubes in the fuel nozzle 12. This may result from air and fuel pressures within each fuel nozzle 12 varying cyclically with time to cause air and fuel pressure fluctuations. The air and fuel pressure fluctuations may drive or cause pressure oscillations of the combustion gases at one or more particular frequencies, which may cause increase wear or damage to the turbine system 10 if the one or more frequencies correspond to a natural frequency of a part or subsystem within the turbine system 10. High-frequency acoustic oscillations, or screech, caused as a result of the air/fuel mixing may be, for example, at a frequency of approximately between 500 to 4000 Hz. In another embodiment, the pressure oscillations may occur, for example, at a frequency of approximately between 1000 to 4000 Hz, 1000 to 3000 Hz, or 1000 to 2500 Hz. As discussed in detail below, addition of a resonator in the fuel nozzle 12 may operate to dampen the pressure oscillations described above.

Figure 4:
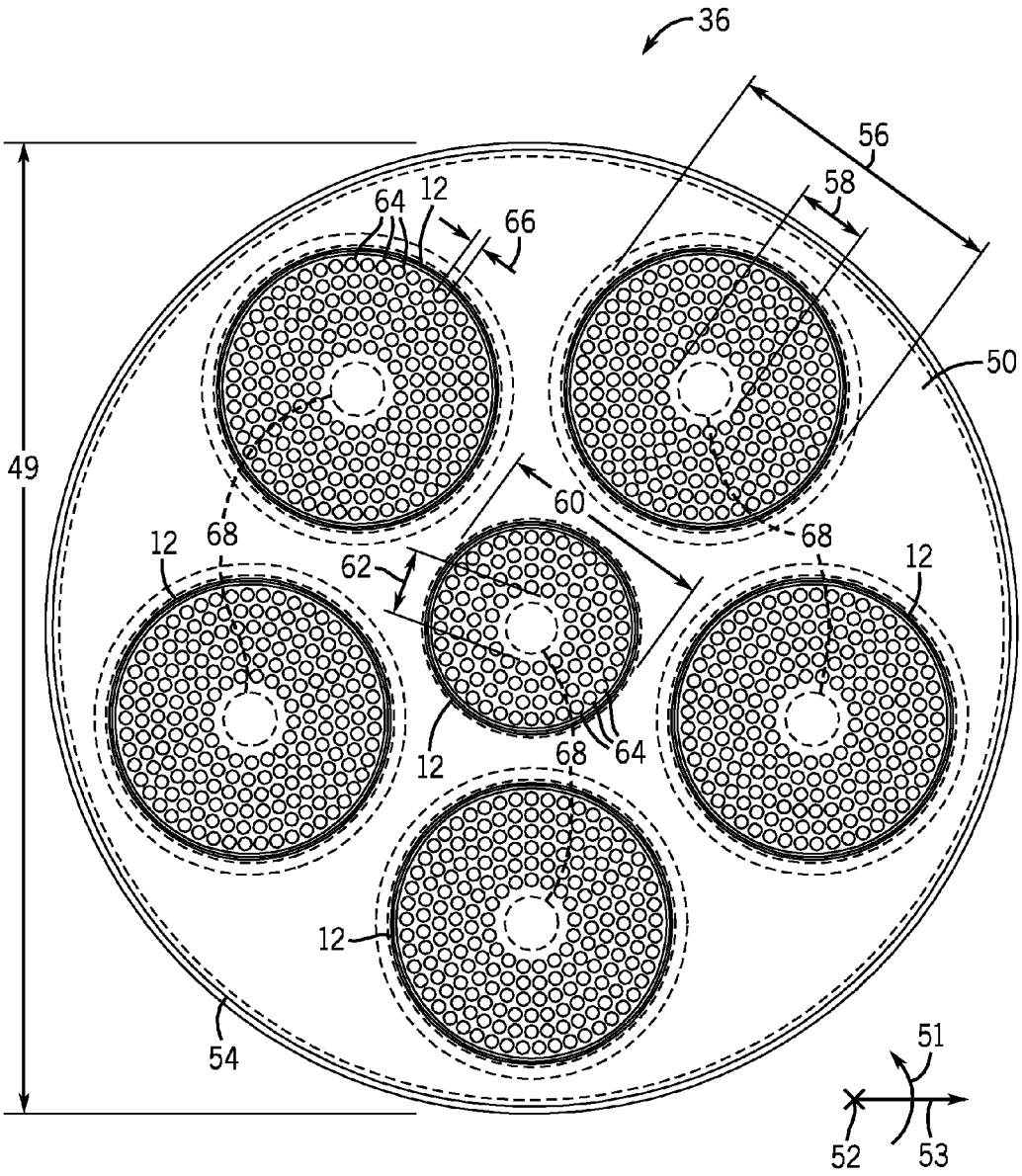
FIG. 4 is a front view of a combustor cap assembly, as illustrated in FIG. 3, in accordance with an embodiment of the present technique.

FIG. 4 illustrates a front view of an embodiment of the combustor cap assembly 36. The combustor cap assembly 36 may include a front plate, or face, 50 through which a plurality of nozzles 12 may extend in an axial direction 52. The outer face 50 of the combustor cap assembly 36 may, for example, be circular in shape with a diameter 49 of approximately between 10 and 25 inches. There may be a plurality of nozzles 12 arranged along the face 50 of the combustor cap assembly 36. In one embodiment, five fuel nozzles 12 may be arranged around an outer circumference 54 of the face 50, with a single fuel nozzle 52 located at an inner portion 55 of the face 50. The fuel nozzles 12 may be alternatively arranged in various other configurations. The fuel nozzles 12 arranged around the outer circumference 54 of the face 50 may each have a diameter 56 of approximately 5 inches. In another embodiment, the diameter 56 may be approximately 2, 3, 4, 5, 6, 7, 8, 9, or 10 inches. Additionally, the fuel nozzles 12 arranged around the outer circumference 54 of the face 50 may each have an inner diameter 58 of approximately 1 inch. In another embodiment, the inner diameter 58 may be approximately 0.5, 0.75, 1, 1.25, 1.5, 1.75, or 2 inches. The fuel nozzle 12 located at the inner portion 55 of the face 50 may have an outer diameter 60 of approximately 3 inches. In another embodiment, the diameter 60 may be approximately 1, 2, 3, 4, 5, 6, 7, 8, 9, or 10 inches. Additionally, the fuel nozzle 12 located at the inner portion 55 of the face 50 may each have an inner diameter 62 of approximately 0.75 inches. In another embodiment, the inner diameter 62 may be approximately 0.3, 0.4, 0.5, 0.6, 0.7, 0.8, 0.9, 1, 1.1, or 1.2 inches.

Between the outer diameter 56 and inner diameter 58, as well as between the diameter 60 and inner diameter 62, of the fuel nozzles 12 may be a plurality of mixing tubes 64. These mixing tubes 64 may operate to provide mixing of air and fuel for efficient combustion of an air/fuel mixture in the combustor 16. Each of the mixing tubes 64 may have a diameter 66 of approximately 0.4 inches. In another embodiment, the diameter 66 may be approximately 0.1, 0.2, 0.3, 0.4, 0.5, 0.6, 0.7, 0.8, 0.9, or 1 inch. Furthermore, there may be approximately between 10 and 1000 mixing tubes 64 disposed in each fuel nozzle 12. In another embodiment, there may be approximately between 10 and 100, 100 and 500, or 100 and 1000 mixing tubes 64 disposed in each fuel nozzle 12.

The inner diameters 58 and 62 of the fuel nozzles 12 may each house an acoustic resonator 68, (e.g., a device inside which a volume of a gas naturally oscillates at specific frequencies, called its resonance frequencies). The resonator 68 may, for example, be a hollow enclosure, such as a cylindrical enclosure. This acoustic resonator 68 may be disposed in the fuel nozzle 12 and may be directly adjacent to the combustion zone 38. The resonator 68 may operate to dampen the acoustic oscillations generated by the combustion process in combustion chamber 38. The combustion oscillations may be partially caused by oscillations in the fuel flow or air flow into the combustion chamber 38 which, when combusted, cause fluctuations in the combustion chamber 38, which then may amplify the fluctuations in fuel flow and/or air flow to the combustion chamber 38. In this way, the amplitude of pressure oscillations in the combustion chamber 38 may rapidly increase. These combustion system pressure oscillations, in turn, may cause pressure oscillations throughout the turbine system 10 that may include acoustic oscillations. Accordingly, by dampening the pressure oscillations (e.g., screech), which would otherwise reduce performance or life of the turbine system 10 by oscillating at one or more natural frequencies of a part or subsystem within the turbine system 10, may be attenuated or even cancelled. As described below, the resonators 68 may be tuned to the specific environment in which they are used based on, for example, the fuel to be utilized in the fuel nozzle 12.

Figure 5:
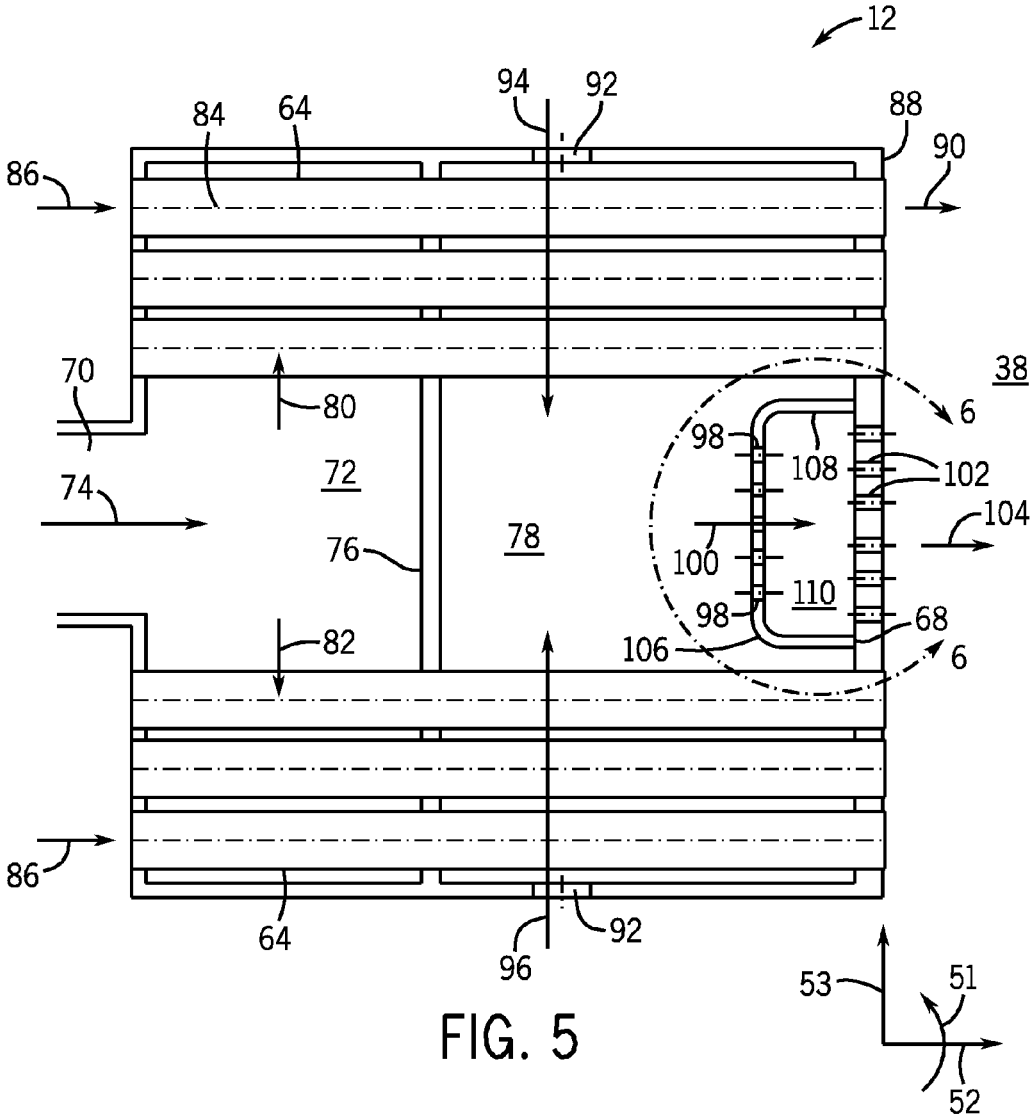
FIG. 5 is cross sectional side view of a fuel nozzle, as illustrated in FIG. 3, having a resonator in accordance with an embodiment of the present technique.

FIG. 5 illustrates a cross sectional side view of a fuel nozzle 12. It should be noted that various aspects of the fuel nozzle 12 may be described with reference to a circumferential direction or axis 51, an axial direction or axis 52, and a radial direction or axis 53. For example, the axis 51 corresponds to the circumferential direction about the longitudinal centerline, the axis 52 corresponds to a longitudinal centerline or lengthwise direction, and the axis 53 corresponds to a crosswise or radial direction relative to the longitudinal centerline.

The fuel nozzle 12 includes mixing tubes 64 and the resonator 68 described above. As illustrated, the fuel nozzle 12 is in communication with the combustion zone 38 of the turbine engine 10. The fuel nozzle 12 may also include a fuel passage 70 that opens into a fuel plenum 72. Fuel may flow axially 52 through the fuel passage 70 into the fuel plenum 72 along directional arrow 74. Once in the fuel compartment 72, the fuel may be held in the fuel compartment 72 by a dividing plate 76 that separates the fuel compartment 72 from an air compartment 78 in the fuel nozzle 12. Contact of the fuel with the dividing plate 76 may cause the fuel to propagate radially 53 along directional lines 80 and 82, as well as cause the fuel to flow circumferentially 51 around the mixing tubes 64 in the fuel compartment 72.

As the fuel flows around the mixing tubes 64, the fuel may enter the mixing tubes 64 via fuel ports 84 in the mixing tubes 64. These fuel ports 84 may, be placed along the surface of the mixing tubes 64 and may be approximately between 0.01 and 0.1 inches in diameter. Thus, the fuel may flow into the mixing tubes 64 and may mix with air moving in an axial direction 52 through the mixing tubes 64 as part of a first air path, as illustrated by directional arrow 86. In one embodiment, a pressure difference between the fuel in the fuel compartment 72 and the air flowing through the mixing tubes 64 bars air from escaping the mixing tubes 64 and entering the fuel compartment 72.

The fuel and air may combine into a fuel/air mixture in the mixing tubes 64. The fuel/air mixture may then axially 52 pass into the combustion zone 38 past a downstream plate 88, as indicated by directional arrow 90, for combustion. Additionally, to aid in producing the proper fuel/air mixture for efficient combustion, additional air may be transmitted into the combustion zone 38 from the air compartment 78. This air compartment 78 may be in the downstream portion of the fuel nozzle 12 (i.e., the portion of the fuel nozzle 12 closest to the combustion zone 38). For example, the air compartment 78 may be in a downstream portion of the fuel nozzle 12 that includes approximately 10, 20, 30, 40, 50, 60, 70, or 80 percent of the total length of the fuel nozzle 12. In one embodiment, only air may flow into air compartment 78, that is, fuel does not flow into air compartment 78. In another embodiment, both fuel and air may flow into the air compartment 78, causing the air compartment to become a fuel/air compartment.

Air may enter the air compartment 78 via one or more air inlets 92, which may be circumferentially 51 disposed around the exterior of the fuel nozzle 12. The air inlets 92 may be, for example, approximately 0.05, 0.10, 0.15, 0.20, 0.25, 0.30, 0.35, 0.40, 0.45, or 0.50 inches in diameter. The air inlets 92 may allow for air to pass radially 53 into the air compartment 78 along lines 94 and 96 and around the mixing tubes 64 as part of a second air path. Once in the air compartment 78, the air may pass axially 52, along directional line 100, through the resonator 68 via air intake ports 98. The air intake ports 98 are inlets to the resonator 68. The air ports 98 may be, for example, approximately 0.01, 0.03, 0.05, 0.1, 0.15, or 0.20 inches in diameter. The air may further axially 52 pass into the combustion zone 38 through air outlet ports 102, as indicated by directional line 104. That is, the air outlet ports 102 directly expel air into the combustion zone 38 of the combustion chamber 16, (e.g., the air outlet ports 102 ejects air away from fuel nozzle 102 as a whole). The air outlet ports 102 may be, for example, approximately 0.05, 0.1, 0.15, 0.2, 0.25, or 0.3 inches in diameter.

Thus, the fuel nozzle 12 may define an enclosure that may be completely sealed with the exception of inlet 70, inlets 92, tubes 64, and the resonator 68 enveloped outlet ports 102. Furthermore, the divider 76 may define two separate enclosures (e.g., fuel compartment 72 and air compartment 78), within the overall enclosure, while the resonator defines a sub-enclosure (e.g., cavity 110) within the downstream enclosure (e.g., the air compartment 78).

As earlier noted, the resonator 68 housed in the fuel nozzle 12 may operate to dampen the acoustic oscillations caused by the combustion process, which may be influenced by air and fuel pressure fluctuations in the mixing tubes 64. In this manner, fluctuations at particular frequencies, which would otherwise reduce performance and life of the turbine system 10 by oscillating at one or more natural frequencies of a part or subsystem within the turbine system 10, may be attenuated or even eliminated. The acoustic oscillations may be largest near the downstream plate 88 of the fuel nozzle 12. Accordingly, it may be beneficial to place the acoustic resonator 68 in the air compartment 78 of the fuel nozzle 12 so as to bring it into close proximity with the location of the pressure oscillations in the combustion chamber 38. As such, the resonator 68 is disposed in the air compartment 78 adjacent a downstream end of the fuel nozzle 12. Additionally, by placing the resonator 68 in the air compartment, the resonator 68 does not detriment the flow of the fuel air mixture into the combustor 16.

The resonator 68 may include an upstream plate 106, at least one side plate 108 that may be joined with the downstream plate 88 to form a resonator cavity 110. The upstream plate 106 may radially 53 extend parallel to the downstream plate 88 and may be, for example, approximately 0.2, 0.4, 0.6, 0.8, 1.0, 1.2, 1.4, 1.6, 1.8, or 2.0 inches wide. The side plate 108 may axially 52 extend from the downstream plate 88 to the upstream plate 106 at a distance of, for example, approximately 0.5, 1, 1.5, 2, 2.5, or 3 inches. Thus the downstream plate 88 and the upstream plate 106 may be parallel, while the side plate 108 extends laterally about a perimeter of the cavity 110. Furthermore, in certain embodiments, the plate 106 may be disc shaped, the side plate may be annular shaped, and/or the cavity 110 may be cylindrical.

The resonator 68 includes the resonator cavity 110 to dampen pressure oscillations (e.g., air, fuel, combustion, etc.) while also flowing air directly into the combustion zone 38 via the air outlet ports 102 along the downstream end of the fuel nozzle 12. That is, due to air and fuel pressure fluctuations (e.g., oscillations) in the mixing tubes 64, an uneven fuel/air mixture may be transmitted into the combustor cavity 38. As this fuel/air mixture is combusted, air may be forced into the cavity 110 via outlet ports 102, thus increasing the pressure inside of the cavity 110, while simultaneously reducing the oscillations in the combustion chamber 38. In this manner, the pressure oscillations may not form acoustic pressure waves. When the pressure oscillations are no longer being generated, (e.g., the fuel/air mixture variation lessens), the elevated pressure in the cavity 110 will force air back through the air outlet ports 102 to equalize the pressure in the cavity 110 with the pressure of the combustion zone 38. This process may be repeated such that the dampening may cause the pressure oscillations to lessen, thus causing fewer or no acoustic oscillations to be generated. In this manner, the resonator 68 dissipates the energy of the pressure oscillations caused by the combustion of a fluctuating fuel/air mixture.

Furthermore, this process may be optimized by tuning the resonator 68, that is, by matching the resonance frequency of the resonator 68 to the oscillations produced in the combustion zone 38. This may be accomplished by changing the dimensions of the air intake ports 98 and the air outlet ports 102, the number of air intake ports 98 and the air outlet ports 102, the geometry (e.g., shape) of the cavity 110, and/or the volume of the cavity 110. The volume of the cavity 110 may be adjusted by changing the length of the upstream plate 106 and/or the side plates 108. Tuning may be based on the pressure oscillations generated in the combustion zone 38. These pressure oscillations may change depending on a number of factors, such as the fuel to be combusted (e.g., synthetic natural gas, substitute natural gas, natural gas, hydrogen, etc.), the number of mixing tubes 64, the diameter 66 of the mixing tubes, the length of the mixing tubes, the fuel/air ratio of the fluid exiting the mixing tubes, the rate at which the fuel/air mixture enters the combustion zone 38, etc. Based on these factors, the resonator 68 may be implemented to counteract the oscillations generated in a given combustion zone 38. Other configurations of the resonator 68 may be utilized, as described below with respect to FIGS. 6-8.

Figure 6:
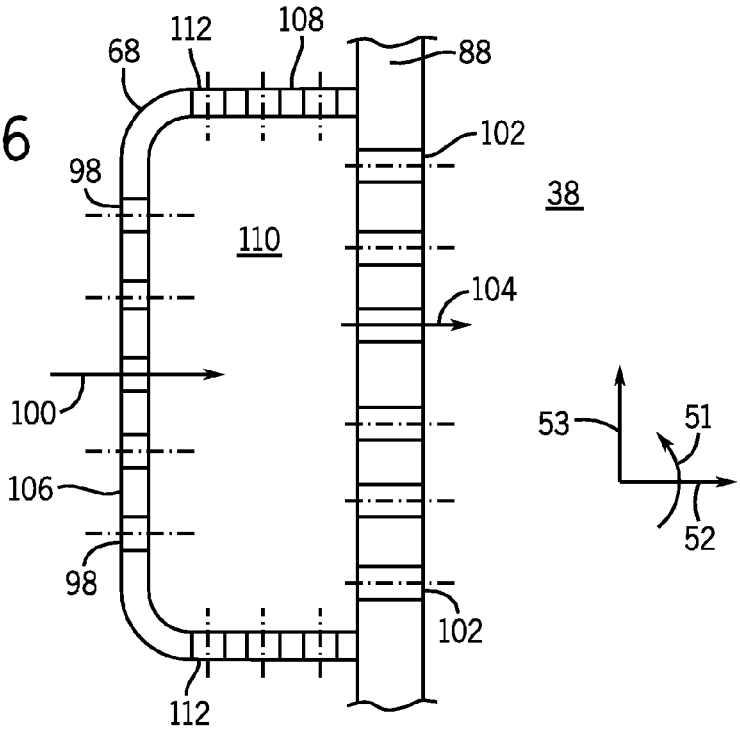
FIG. 6 is a cross sectional side view of the resonator, as illustrated within arcuate line 6-6 of FIG. 5, in accordance with an embodiment of the present technique.

FIG. 6 illustrates a cross sectional side view of the resonator 68, as illustrated within arcuate line 6-6 of FIG. 5. The resonator 68 may include air intake ports 98, air outlet ports 102, upstream plate 106, and side plates 108, as described above with respect to FIG. 5. The air intake ports 98 may be radially 53 aligned on the resonator 68 to allow air to axially 52 pass into the cavity 110 along directional line 100, while air outlet ports 102 may allow air to pass from the cavity 110 into the combustion zone 38, as illustrated via directional line 104. Additionally, the resonator 68 may include additional air intake ports 112 in the side plates 108. These additional air intake ports 112 may have the same dimensions as air intake ports 98.

Figure 7:
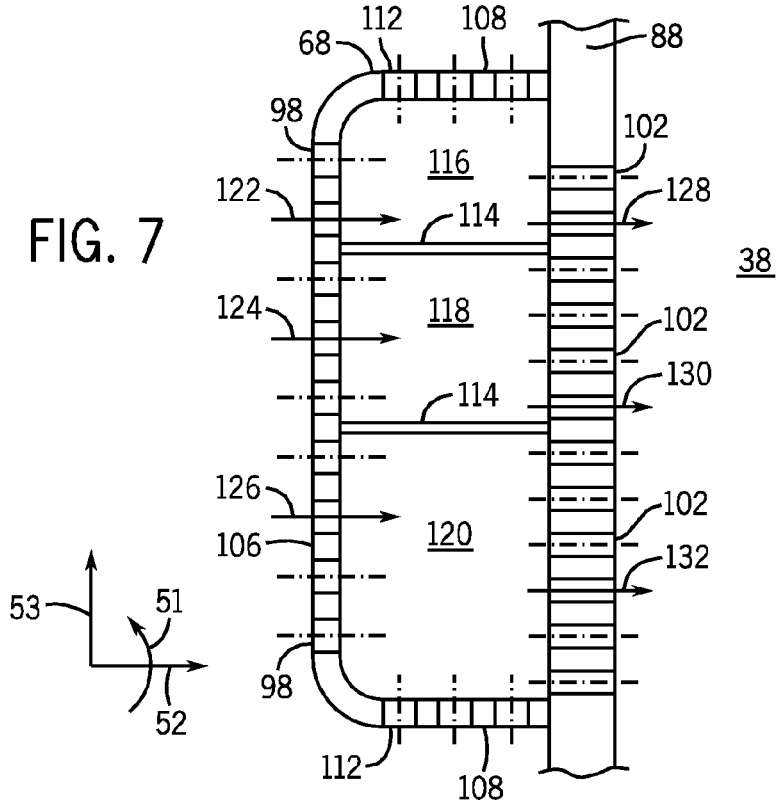
FIG. 7 is a cross sectional side view of the resonator, as illustrated within arcuate line 6-6 of FIG. 5, in accordance with another embodiment of the present technique.

FIG. 7 illustrates a cross sectional side view of the resonator 68, as illustrated within arcuate line 6-6 of FIG. 5. The resonator 68 may include air intake ports 98, air outlet ports 102, upstream plate 106, side plates 108, additional air intake ports 112, similarly as described above with respect to FIGS. 5 and 6. Additionally, the resonator 68 may include one or more divider plates 114. The divider plates 114 may operate to fluidly seal cavity 116, from cavity 118, and to fluidly seal cavity 118 from cavity 120. Thus, air intake ports 98 and additional air intake ports 112 may allow air to axially 52 pass independently into the cavities 116, 118, and 120 along directional lines 122, 124, and 126, respectively. Similarly, air outlet ports 102 may allow air to pass from the cavities 116, 118, and 120 independently into the combustion zone 38, as illustrated via directional lines 128, 130, and 132, respectively.

As described above, the divider plates 114 may divide the resonator 68 into a plurality of cavities 116, 118, and 120. It should be noted that the resonator 68 may be divided into any number of cavities via use of one or more divider plates 114. In one embodiment, the cavities 116, 118, and 120 may be of different volumes. For example, the volume of the cavity 116 may be approximately 20%, 30%, 40%, 50%, 60%, 70%, or 80% the volume of cavity 118, while the volume of the cavity 118 may be approximately 20%, 30%, 40%, 50%, 60%, 70%, or 80% the volume of cavity 120. By further example, the cavities 116, 118 and 120 may have progressively larger volumes as a ratio to the total volume of the resonator 68, e.g., 12.5%, 37.5%, and 50%. In this manner, the resonator 68 may be tuned to dissipate multiple bands of frequencies of combustion pressure oscillations generated in the combustion zone 38, that is, each cavity 116, 118, and 120 may dissipate acoustic waves of a different frequency. In addition to the rectangular shaped cavities 116, 118, and 120 in FIG. 7, each cavity 116, 118, and 120 may be a semi-cylindrical shape or segment of a cylindrical volume defined by plates 88, 106, and 108.

Figure 8:
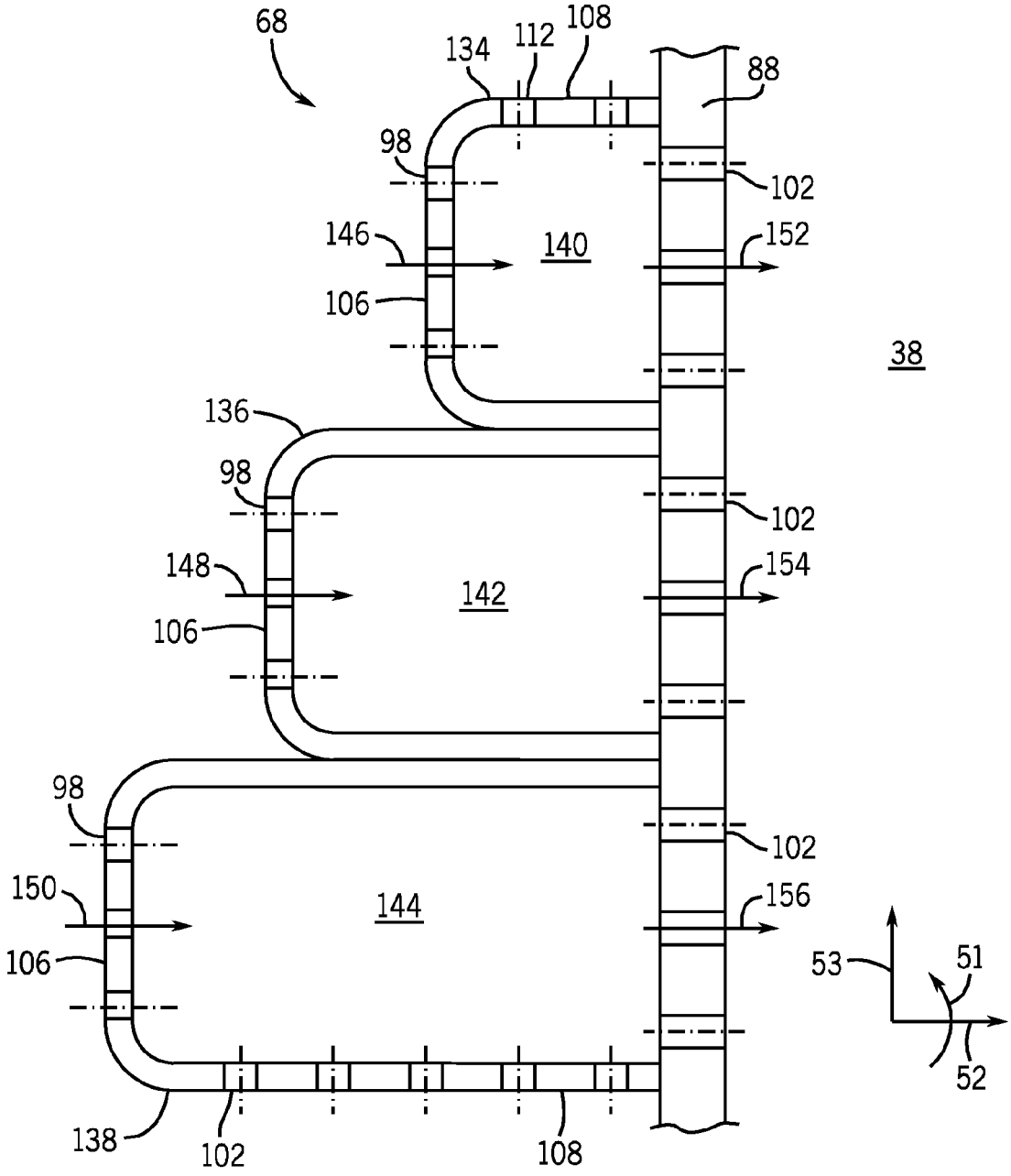
FIG. 8 is a cross sectional side view of the resonator, as illustrated within arcuate line 6-6 of FIG. 5, in accordance with another embodiment of the present technique.

FIG. 8 illustrates a cross sectional side view of the resonator 68, as illustrated within arcuate line 6-6 of FIG. 5. The resonator 68 may include multiple resonator sections 134, 136, and 138. Each of the resonator sections 134, 136, and 138 may function as an individual cavity resonator. Accordingly, each resonator section 134, 136, and 138 includes a resonator cavity 140, 142, and 144, respectively. Furthermore, the resonator sections 134, 136, 138 may include air intake ports 98, air outlet ports 102, upstream plate 106, and side plates 108, as described above with respect to FIG. 5. The air intake ports 98 may allow air to axially 52 pass into the cavities 140, 142, and 144 along directional lines 146, 148, and 150, while air outlet ports 102 may allow air to pass from the cavities 140, 142, and 144 into the combustion zone 38, as illustrated via directional lines 152, 154, and 156. Additionally, one or more of the resonator sections 134, 136, and 138 may include additional air inlet ports 112 similar to those described above with respect to FIGS. 5, 6, and 7.

Additionally, the cavities 140, 142, and 144 may be of different volumes. For example, the volume of the cavity 140 may be approximately 20%, 30%, 40%, 50%, 60%, 70%, or 80% the volume of cavity 142, while the volume of the cavity 142 may be approximately 20%, 30%, 40%, 50%, 60%, 70%, or 80% the volume of cavity 144. By further example, the cavities 140, 142, and 144 may have progressively larger volumes as a ratio to the total volume of the resonator 68, e.g., 12.5%, 37.5%, and 50%. In this manner, the resonator 68 may be tuned to dissipate various frequencies generated in the combustion zone 38, that is, each cavity 140, 142, and 144 and each resonator section 134, 136, and 138 may dissipate acoustic waves of a different frequency. In addition to the rectangular shaped cavities 140, 142, and 144 in FIG. 8, each cavity 140, 142, and 144 may be a semi-cylindrical shape or segment of a cylindrical volume defined by plates 88, 106, and 108. The cylindrical shaped cavities 140, 142, and 144 may be, for example, cylinders of different lengths adjacent one another. Alternatively, the cylindrical shaped cavities 140, 142, and 144 may be, for example, concentrically aligned to define ring-like chambers.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a turbine engine, comprising:

a combustor configured to house one or more fuel nozzles, wherein the combustor comprises a fuel nozzle having a downstream plate, an air path, and a fuel path, wherein the fuel nozzle is in communication with a combustion zone of the turbine engine via the downstream plate of the fuel nozzle; and a resonator disposed in a chamber in the fuel nozzle directly adjacent to the combustion zone, wherein the chamber is defined by a dividing plate separating the fuel nozzle into a plurality of compartments, the downstream plate, and a cylindrical sidewall coupled to each of the dividing plate and the downstream plate, wherein the resonator comprises a resonator plate coupled to the downstream plate of the fuel nozzle, wherein the resonator plate is separate, distinct, and spaced from each of the dividing plate and the cylindrical sidewall, and separate and distinct from the downstream plate.

2. The system of claim 1, wherein the resonator is disposed in the air path.

3. The system of claim 1, wherein the resonator is disposed in a fuel nozzle cavity adjacent the downstream plate of the fuel nozzle as the chamber.

4. The system of claim 3, wherein the resonator comprises a hollow enclosure defining a resonator chamber, the hollow enclosure comprises a resonator inlet within the fuel nozzle cavity, and the hollow enclosure comprises a resonator outlet along the downstream end of the fuel nozzle.

5. The system of claim 4, wherein the resonator inlet comprises a radial inlet, an axial inlet, or both, through the hollow enclosure, and the resonator outlet comprises an axial outlet.

6. The system of claim 1, comprising:

a central fuel cavity in the fuel path, wherein the central fuel cavity concentrically encloses the mixing tubes; and a central air cavity enclosing both the mixing tubes and the resonator.

7. The system of claim 6, comprising a central air cavity enclosing both the mixing zone and the resonator as the air compartment.

8. A system, comprising:

a fuel nozzle sized to be utilized in a combustor configured to house one or more fuel nozzles, the fuel nozzle comprising a downstream plate, wherein the fuel nozzle is configured to mount in communication with a combustion zone of a turbine engine via the downstream plate of the fuel nozzle, wherein the fuel nozzle comprises:

a fuel path configured to supply fuel;

an air path configured to supply air; and a resonator disposed in a chamber in the fuel nozzle directly adjacent to the combustion zone, wherein the chamber is defined by a dividing plate separating the fuel nozzle into a plurality of compartments, the downstream plate, and a cylindrical sidewall coupled to each of the dividing plate and the downstream plate, wherein the resonator comprises a resonator plate coupled to the downstream plate of the fuel nozzle, wherein the resonator plate is separate, distinct, and spaced from each of the dividing plate and the cylindrical sidewall, and separate and distinct from the downstream plate.

9. The system of claim 8, wherein the resonator plate comprises an upstream plate and a plurality of side plates, wherein the upstream plate is coupled to the side plates to define a resonator chamber.

10. The system of claim 9, wherein the resonator comprises a tuned resonator, wherein the resonator is tuned to dampen acoustic oscillations generated by a combustion process adjacent to an outer wall of the fuel nozzle based on the length of the upstream plate and the length of the side plates.

11. The system of claim 10, comprising an air outlet extending through the outer wall of the fuel nozzle and a second air inlet disposed on at least one of the side plates for providing air to the resonator chamber.

12. The system of claim 8, wherein the resonator comprises a tuned resonator, wherein the resonator is tuned to dampen acoustic oscillations generated by combustion adjacent to an outer wall of the fuel nozzle based on dimensions and number of air inlets and air outlets disposed in a resonator chamber of the resonator.

13. The system of claim 8, comprising an air inlet and an air outlet disposed in a resonator chamber of the resonator, wherein the air inlet is approximately 0.05 inches in diameter and the air outlet is approximately 0.1 inches in diameter.

14. The system of claim 8, comprising a plurality of mixing tubes disposed in the fuel path and concentrically disposed about the resonator.

15. The system of claim 14, comprising a central fuel cavity in the fuel path, wherein the central fuel cavity concentrically encloses the mixing tubes and a central air cavity enclosing both the mixing tubes and the resonator.

16. The system of claim 8, wherein the fuel nozzle comprises a mixing zone disposed directly adjacent the downstream plate and configured to mix fuel and air to generate a fuel/air mixture.

17. A fuel nozzle, comprising:

a downstream plate;

a fuel path, wherein the fuel nozzle is located in the fuel path, wherein the fuel nozzle is configured to mount in communication with a combustion zone of a turbine engine via the downstream plate of the fuel nozzle;

an air compartment in a downstream portion of the fuel nozzle, wherein the air compartment is circumferentially surrounded by the fuel path, wherein the air compartment is defined by a dividing plate separating the fuel nozzle into a plurality of compartments, the downstream plate, and a cylindrical sidewall coupled to each of the dividing plate and the downstream plate;

an air path configured to supply air to the air compartment; and a resonator disposed in the air compartment of the fuel nozzle directly adjacent to the combustion zone, wherein the resonator comprises a resonator plate coupled to the downstream plate of the fuel nozzle, wherein the resonator plate is separate, distinct, and spaced from each of the dividing plate and the cylindrical sidewall, and separate and distinct from the downstream plate, wherein the fuel nozzle is sized to be utilized in a combustor configured to house one or more fuel nozzles.

18. The fuel nozzle of claim 17, wherein the resonator is configured to dampen pressure oscillations between approximately 1000 to 4000 Hz.

19. The fuel nozzle of claim 17, wherein the resonator comprises a resonator inlet configured to allow air to pass into a cavity within the resonator and a resonator outlet configured to allow air to pass from the cavity within the resonator through the downstream plate of the fuel nozzle.

20. The fuel nozzle of claim 17, comprising a central fuel cavity in the fuel path, wherein the central fuel cavity concentrically encloses the mixing tubes, wherein the air compartment comprises a central air cavity enclosing both the mixing tubes and the resonator.

* * * * *